US009028303B2

(12) United States Patent
Gosamo et al.

(10) Patent No.: US 9,028,303 B2
(45) Date of Patent: May 12, 2015

(54) ABRASIVE ARTICLE FOR SHAPING OF INDUSTRIAL MATERIALS

(71) Applicants: Saint-Gobain Abrasives, Inc., Worcester, MA (US); Saint-Gobain Abrasifs, Conflans-Sainte-Honorine (FR)

(72) Inventors: Ignazio Gosamo, Léglise-Thibessart (BE); Sebastien Marcel Robert Douveneau, Angevillers (FR); André R. G. Heyen, Malmedy (BE); Emmanuel Thil, Bousse (FR)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 14/062,629

(22) Filed: Oct. 24, 2013

(65) Prior Publication Data

US 2014/0051340 A1 Feb. 20, 2014

Related U.S. Application Data

(62) Division of application No. 13/180,991, filed on Jul. 12, 2011, now Pat. No. 8,591,295.

(60) Provisional application No. 61/363,601, filed on Jul. 12, 2010.

(51) Int. Cl.
*B24D 7/06* (2006.01)

(52) U.S. Cl.
CPC ..... *B24D 7/06* (2013.01)

(58) Field of Classification Search
CPC ..... B24D 5/06; B24D 99/005; B24D 7/066; B28D 1/122
USPC ..... 451/541, 543, 547, 548
See application file for complete search history.

(56) References Cited

U.S. PATENT DOCUMENTS

| | | | | |
|---|---|---|---|---|
| 1,676,887 A | | 7/1928 | Chamberlin | |
| 1,949,513 A | * | 3/1934 | Greenwood | 451/543 |
| 1,954,330 A | * | 4/1934 | Schurr | 451/543 |
| 3,088,251 A | | 5/1963 | Davis | |
| 3,590,535 A | | 7/1971 | Benson et al. | |

(Continued)

FOREIGN PATENT DOCUMENTS

| | | |
|---|---|---|
| CN | 87208852 U | 12/1987 |
| CN | 1040535 A | 3/1990 |

(Continued)

OTHER PUBLICATIONS

Beijing Factory 152, A new method of making diamond abrasive tools, Aug. 29, 1974, Non-metallic minerals, pp. 62-64, vol. 4.

(Continued)

*Primary Examiner* — Timothy V Eley
(74) *Attorney, Agent, or Firm* — Abel Law Group, LLP; Joseph P. Sullivan

(57) ABSTRACT

An abrasive article including a base having an annular shape defining a central opening; and a mounting assembly coupled to the base, wherein a portion of the mounting assembly is under a compressive force, and a grinding segment coupled to the mounting member.

20 Claims, 6 Drawing Sheets

(56) References Cited

U.S. PATENT DOCUMENTS

| | | | | |
|---|---|---|---|---|
| 3,594,141 | A | 7/1971 | Houston et al. | |
| 3,613,472 | A | 10/1971 | Held | |
| 3,777,443 | A * | 12/1973 | Shaw | 451/543 |
| 3,850,590 | A | 11/1974 | Chalkley et al. | |
| 3,955,324 | A | 5/1976 | Lindstrom | |
| 4,155,721 | A | 5/1979 | Fletcher | |
| 4,208,154 | A | 6/1980 | Gundy | |
| 4,224,380 | A | 9/1980 | Bovenkerk et al. | |
| 4,397,555 | A | 8/1983 | Malcolm et al. | |
| 4,453,484 | A | 6/1984 | Englund | |
| 4,689,919 | A | 9/1987 | Kawakita et al. | |
| 4,925,457 | A | 5/1990 | deKok et al. | |
| 4,931,363 | A | 6/1990 | Slutz et al. | |
| 4,977,710 | A | 12/1990 | Une | |
| 5,049,165 | A | 9/1991 | Tselesin | |
| 5,074,080 | A | 12/1991 | Erhardt et al. | |
| 5,082,070 | A | 1/1992 | Obermeier et al. | |
| 5,092,910 | A | 3/1992 | deKok et al. | |
| 5,127,197 | A | 7/1992 | Brukvoort et al. | |
| 5,127,923 | A | 7/1992 | Bunting et al. | |
| 5,190,568 | A | 3/1993 | Tselesin | |
| D342,270 | S | 12/1993 | Kwang | |
| 5,380,390 | A | 1/1995 | Tselesin | |
| 5,385,591 | A | 1/1995 | Ramanath et al. | |
| 5,505,750 | A | 4/1996 | Andrews | |
| 5,507,686 | A * | 4/1996 | Wolters | 451/63 |
| 5,518,443 | A | 5/1996 | Fisher | |
| 5,718,736 | A | 2/1998 | Onishi et al. | |
| 5,791,330 | A | 8/1998 | Tselesin | |
| 5,817,204 | A | 10/1998 | Tselesin | |
| 5,865,571 | A | 2/1999 | Tankala et al. | |
| 5,868,125 | A | 2/1999 | Maoujoud | |
| 5,906,245 | A | 5/1999 | Tibbits et al. | |
| 5,932,508 | A | 8/1999 | Armstrong et al. | |
| 5,980,678 | A | 11/1999 | Tselesin | |
| 6,024,635 | A | 2/2000 | Cruickshank et al. | |
| 6,033,295 | A | 3/2000 | Fisher et al. | |
| 6,039,641 | A | 3/2000 | Sung | |
| 6,192,875 | B1 | 2/2001 | Koroku et al. | |
| 6,193,770 | B1 | 2/2001 | Sung | |
| 6,273,082 | B1 | 8/2001 | Tselesin | |
| 6,286,498 | B1 | 9/2001 | Sung | |
| D458,948 | S | 6/2002 | Chianese et al. | |
| D459,375 | S | 6/2002 | Chianese et al. | |
| D459,376 | S | 6/2002 | Chianese et al. | |
| D459,740 | S | 7/2002 | Chianese et al. | |
| 6,453,899 | B1 | 9/2002 | Tselesin | |
| 6,458,471 | B2 | 10/2002 | Lovato et al. | |
| 6,482,244 | B2 | 11/2002 | Tselesin | |
| 6,485,533 | B1 | 11/2002 | Ishizaki et al. | |
| 6,752,709 | B1 | 6/2004 | Skibo et al. | |
| 6,755,729 | B2 | 6/2004 | Ramanath et al. | |
| 6,817,936 | B1 | 11/2004 | Skeem et al. | |
| 6,827,072 | B2 | 12/2004 | Schwammle | |
| 6,872,133 | B2 | 3/2005 | Lee et al. | |
| 6,878,051 | B2 | 4/2005 | Brach | |
| 6,935,940 | B2 | 8/2005 | Skeem et al. | |
| 7,210,474 | B2 | 5/2007 | Gaida et a | |
| 7,444,914 | B2 | 11/2008 | Brach | |
| 7,879,129 | B2 | 2/2011 | Kosters et al. | |
| 7,946,907 | B2 | 5/2011 | Heyen | |
| 8,591,295 | B2 * | 11/2013 | Gosamo et al. | 451/543 |
| 2001/0023558 | A1 | 9/2001 | Tselesin | |
| 2001/0025457 | A1 | 10/2001 | Tselesin | |
| 2002/0129807 | A1 | 9/2002 | Cervantes | |
| 2003/0213483 | A1 | 11/2003 | Sakarcan | |
| 2003/0232586 | A1 | 12/2003 | Ramanath et al. | |
| 2005/0235978 | A1 | 10/2005 | Kim et al. | |
| 2005/0279533 | A1 | 12/2005 | Corica | |
| 2006/0160476 | A1 | 7/2006 | Bright et al. | |
| 2006/0185492 | A1 | 8/2006 | Chianese | |
| 2007/0099548 | A1 | 5/2007 | Kumar et al. | |
| 2008/0076338 | A1 | 3/2008 | Andrews et al. | |
| 2008/0153402 | A1 | 6/2008 | Arcona et al. | |
| 2009/0199692 | A1 | 8/2009 | Heyen | |
| 2009/0199693 | A1 | 8/2009 | Heyen | |
| 2010/0035530 | A1 | 2/2010 | Gosamo et al. | |
| 2010/0200304 | A1 | 8/2010 | Gosamo et al. | |
| 2010/0248600 | A1 | 9/2010 | Chianese et al. | |
| 2010/0279138 | A1 | 11/2010 | Zheng | |
| 2011/0023911 | A1 | 2/2011 | Lenkeit et al. | |

FOREIGN PATENT DOCUMENTS

| | | | |
|---|---|---|---|
| CN | 1239451 | A | 12/1999 |
| CN | 201295881 | Y | 8/2009 |
| DE | 19650718 | A1 | 6/1998 |
| EP | 0917939 | | 5/1999 |
| EP | 0925378 | B1 | 4/2002 |
| EP | 0871562 | B1 | 1/2003 |
| EP | 2075092 | A2 | 7/2009 |
| FR | 2532875 | A1 | 3/1984 |
| GB | 822058 | A | 10/1959 |
| GB | 2086822 | | 5/1982 |
| GB | 2086823 | | 5/1982 |
| GB | 2086824 | | 5/1982 |
| JP | 51121880 | A | 10/1976 |
| JP | S60178568 | U | 11/1985 |
| JP | 6268764 | A | 4/1987 |
| JP | 01-246077 | A | 10/1989 |
| JP | H02160475 | A | 6/1990 |
| JP | 03-060981 | A | 3/1991 |
| JP | 8066869 | A | 3/1996 |
| JP | 3034101 | A | 11/1996 |
| JP | H08323631 | A | 12/1996 |
| JP | 11-000915 | A | 1/1999 |
| JP | 2000061932 | A | 2/2000 |
| JP | 2001038718 | A | 2/2001 |
| JP | 2001527469 | A | 12/2001 |
| JP | 2002028856 | A | 1/2002 |
| JP | 2002079469 | A | 3/2002 |
| JP | 2002530212 | A | 9/2002 |
| JP | 2003011113 | A | 1/2003 |
| JP | 2003011115 | A | 1/2003 |
| JP | 3092359 | U | 3/2003 |
| JP | 2003103410 | A | 4/2003 |
| JP | 2004524170 | A | 8/2004 |
| JP | 200790565 | A | 4/2007 |
| JP | 2007136817 | A | 6/2007 |
| JP | 2007517675 | A | 7/2007 |
| JP | 2007216306 | A | 8/2007 |
| JP | 2009078055 | A | 4/2009 |
| JP | 2011530417 | A | 12/2011 |
| KR | 10-0263787 | B1 | 5/2000 |
| RU | 410955 | | 1/1974 |
| RU | 799956 | | 1/1981 |
| RU | 1175724 | | 8/1985 |
| SU | 844258 | A1 | 7/1981 |
| WO | 9810110 | A1 | 3/1998 |
| WO | 9824593 | A1 | 6/1998 |
| WO | 9857771 | A1 | 12/1998 |
| WO | 0030808 | A1 | 6/2000 |
| WO | 0245907 | A2 | 6/2002 |
| WO | 2006031044 | A1 | 3/2006 |
| WO | 2010016959 | A2 | 2/2010 |
| WO | 2010097223 | A1 | 9/2010 |
| WO | 2010118440 | A2 | 10/2010 |
| WO | 2011029106 | A2 | 3/2011 |

OTHER PUBLICATIONS

Shi Xingkuan, et al., The Function of Wheel Infiltrant and the Its Suitable Selection, Tool Engineering, Sep. 22, 1995, pp. 23-26, vol. 29, Issue 9.

Norton, "Silencio" Clipper, 2009, pp. 26-27.

Norton, "Silencio" Clipper, 2010, pp. 28-29.

Norton, Saint-Gobain, "Silencio" Clipper, 2011, pp. 28-29.

Norton, Saint-Gobain, "Silencio" Clipper, 2012, pp. 24-25.

Norton, Saint-Gobain Abrasives, "Technical and Sales Argumentation" 2008, 12 pages.

Norton, Saint-Gobain Abrasives S.A., "Silencio" EN13236, 2011, 2 pages.

(56) References Cited

OTHER PUBLICATIONS

Norton, Saint-Gobain Abrasives, "Silencio—Product Sheet", 2009, 1 page.
Hilti, "A breakthrough in speed", Hilti DD-B Series Core Bits, 2001, Hilti Corporation, http://hilti.com, 7 pages.
International Search Report for PCT/US2010/023807 dated Sep. 30, 2010, 7 pgs.
International Search Report for PCT/US2009/043356 dated Apr. 12, 2010, 8 pgs.
International Search Report for PCT/US2010/062633 dated Sep. 27, 2011, 6 pgs.
International Search Report for PCT/US2010/041858 dated Aug. 17, 2011, 10 pgs.
U.S. Appl. No. 12/703,407, filed Feb. 10, 2010, Inventors: Ignazio Gosamo et al.
U.S. Appl. No. 12/463,228, filed May 8, 2009, Inventors: Ignazio Gosamo et al.
U.S. Appl. No. 12/983,075, filed Dec. 31, 2010, Inventors: Marc Linh Hoang et al.
Office Action dated Oct. 8, 2012 from Russian Application No. 2011137203, 3 pages.
Office Action dated Dec. 18, 2012 from Japanese Patent Application No. 2011-522075, 4 pages.

* cited by examiner

ABRASIVE ARTICLE FOR SHAPING OF INDUSTRIAL MATERIALS

CROSS-REFERENCE TO RELATED APPLICATION(S)

The present application is a divisional of and claims priority to U.S. Non-provisional patent application Ser. No. 13/180,991, filed Jul. 12, 2011, titled "Abrasive Article For Shaping of Industrial Materials," naming inventors Ignazio Gosamo, Sebastien Marcel Robert Douveneau, André R. G. Heyen and Emmanuel Thil, which application claims priority from U.S. Provisional Patent Application No. 61/363,601, filed Jul. 12, 2010, titled "Abrasive Article for Shaping of Industrial Materials," naming inventors Ignazio Gosamo, Sebastien Marcel Robert Douveneau, Andre R. G. Heyen, and Emmanuel Thil, of which both applications are incorporated by reference herein in their entirety.

BACKGROUND

1. Field of the Disclosure

The following is directed to an abrasive article, and particularly an abrasive article for shaping industrial materials.

2. Description of the Related Art

Tools necessary for maintaining infrastructure, including improved building materials and tools suitable for improving building materials, are vital. Additionally, developing regions have a continuing need to replace aging infrastructure with new and expanded materials.

The construction industry utilizes a variety of tools for cutting and grinding of construction materials. Abrasive tools are required for shaping of various materials in various applications, including finishing of roads, stone slabs used for floors, and brick used as interior and exterior building components. Typically, such abrasive tools are used to shape industrial materials through grinding, polishing, cutting or a combination of such processes. Abrasive tools can include a base element, such as a plate or a wheel, and in certain instances, can be in the shape of a grinding wheel, which can utilize a series of grinding segments attached to the base, which can be rotated at high speeds for shaping of the industrial material.

During use, portions of the abrasive article, such as the grinding segments, can become worn and require replacement. Breakage of the bond between the grinding segment and the base element can require replacement of the grinding segment and/or the base element, resulting in down time and lost productivity. Additionally, breakage can pose a safety hazard when portions of the grinding segment are ejected at high speed from the work area. A typical replacement operation will depend on how the segments are secured to the base. In instances where a grinding segment is brazed or welded to a bonding interface, which is fastened to the base, the entire base has to be removed from the machine, such that a technician can access the connection between the bonding interface and the base. After replacing the worn grinding segment, the bonding interface and new grinding segment must be attached to the base and thereafter, the abrasive article must be balanced for proper operation.

SUMMARY

According to one aspect, an abrasive article includes a base having an annular shape defining a central opening, and a mounting assembly coupled to the base, wherein a portion of the mounting assembly is under a compressive force, and a grinding segment coupled to the mounting member.

In another aspect, an abrasive article includes a base having an annular shape defining a central opening, a mounting assembly removably attached to the base, and a grinding segment comprising a grinding segment body coupled to a sector, wherein the mounting assembly exerts a clamping force on the sector.

In yet another aspect, an abrasive article has a base, a mounting assembly coupled to the base via a fastener, wherein the fastener is movable between an engaged position, wherein the fastener is fully seated within the mounting assembly, and a disengaged position, wherein the fastener is partially unseated within the mounting assembly. The article further includes a grinding segment coupled to the mounting assembly, wherein the grinding segment is removable when the fastener is in a disengaged position.

According to another aspect, an abrasive article includes a base, a mounting assembly coupled to the base, wherein the mounting assembly comprises an upper mounting member coupled to a separate and discrete lower mounting member, and a grinding segment coupled to a sector, wherein the sector is clamped between a surface of the upper mounting member and a surface of the lower mounting member.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following is generally directed to abrasive articles, and more particularly, segmented grinding wheels and segmented grinding rings used to grind industrial materials such as ceramic, stone, concrete, and/or brick. In particular, the following abrasive articles disclosed herein may be useful for finishing of building materials.

Figure 1A:
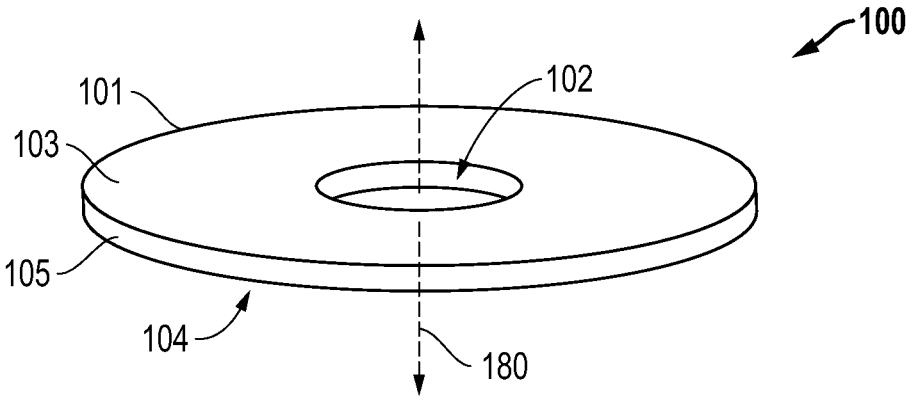
FIG. 1A includes a perspective view illustration of a base of an abrasive article in accordance with an embodiment.

FIG. 1A includes a perspective view illustration of a base of an abrasive article in accordance with an embodiment. As illustrated, the base 101 can have a cylindrical, three-dimensional shape. More particularly, the base 101 can have an annular shape defining a central opening 102 extending through the body of the base 101. The central opening 102 may be suitable for attachment of the base 101 to a machine equipped for rotation of the base 101 for carrying out shaping operations. For example, a spindle of a machine may be engaged within the central opening 102 of the base 101, which may be in turn connected to a rotor suitable for rotating the base 101.

As illustrated, the base 101 can have an upper surface 103 which is a major planar surface extending generally perpendicular to the central axis 180 and a rear surface 104 opposite the upper surface 103 extending parallel to the upper surface 103 and generally perpendicular to the axis 180 extending through a center point in the central opening 102. Moreover, the base 101 can have an outer side surface 105 extending axially between the upper surface 103 and rear surface 104 the upper surface 103 and rear surface 104. The outer side surface 105 also extends circumferentially around the base 101 defining the outer peripheral surface of the base 101.

In accordance with an embodiment, the base 101 can be made from an inorganic material, such as a metal or metal alloy. In certain instances, the base can be formed of a metal alloy such as steel. For example, the base 101 can include heat treatable steel alloys, such as 30CrNiMo8, 25CrMo4, 75Cr1, C60, or simple construction steel like St 37, St 57, and St 60. The base 101 can have a tensile strength of at least about 600 $N/mm^2$. The base element can be formed by a variety of metallurgical techniques known in the art.

Figure 1B:
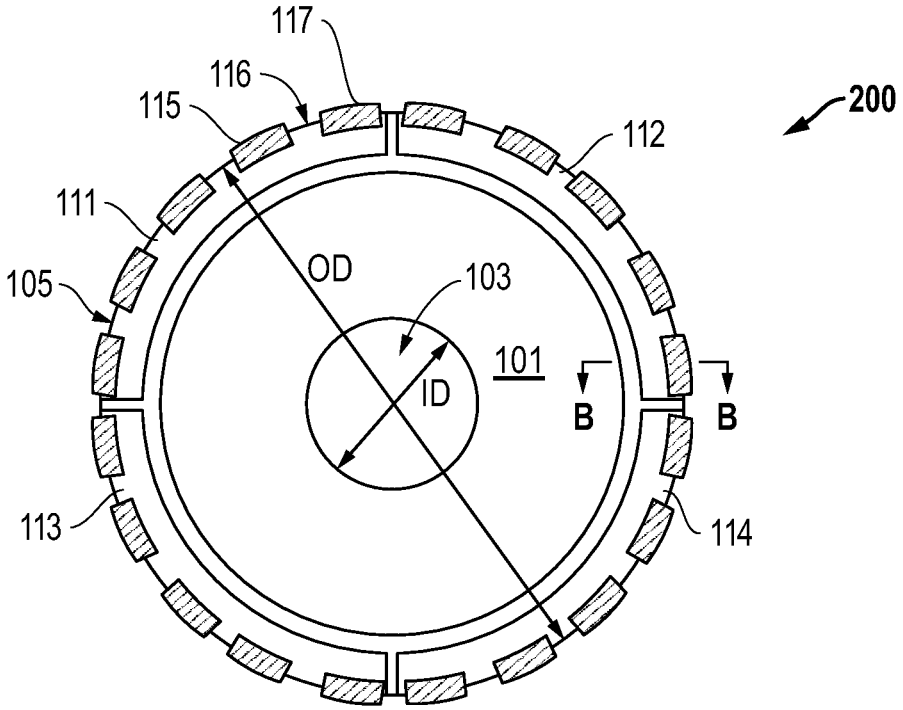
FIG. 1B includes a top view illustration of an abrasive article in accordance with an embodiment.

FIG. 1B includes a top view illustration of an abrasive article in accordance with an embodiment. As illustrated, the abrasive article 200 can include the base 101 described in FIG. 1A. The central opening 102 can have a diameter than defines an inner diameter (ID) of the base 101. As further illustrated, the base 101 can include an outer diameter (OD) extending through the center point of the central opening 102 and between the outer side surface 105 of the base 101, as illustrated in FIG. 1B. In accordance with an embodiment, the base 101 can be a relatively large article such that the outer diameter (OD) can be at least about 200 mm. In other embodiments, the outer diameter of the base 101 can be greater, such as at least about 300 mm, at least about 400 mm, at least about 500 mm, and particularly within a range between about 200 to about 1600 mm.

As further illustrated in FIG. 1B, the abrasive article 200 can include mounting assemblies 111, 112, 113, and 114 (111-114) disposed on the upper surface 103 of the base 101 and arranged circumferentially around the base 101 adjacent to and/or abutting the outer side surface 105. Each of the mounting assemblies 111-114 can be circumferentially spaced apart from each other along an outer circumference of the base 101, such that a circumferential gap may exist between each of the mounting assemblies. It will be appreciated that while the abrasive article 200 is illustrated as including four mounting assemblies 111-114 are illustrated, other embodiments, may utilize a fewer or greater number of mounting assemblies. Notably, use of a plurality of mounting assemblies, among other advantages, allows for sectioning of the tool, and servicing of isolated sections of the abrasive article as necessary, instead of dismantling of the entire abrasive article for servicing.

Additionally, each of the mounting assemblies 111-114 can be removably coupled to the base 101. Removable coupling attachments can include snap-fit connections, interlocking engagement connections, and fasteners. According to one particular embodiment, the mounting assemblies 111-114 are fastened to the base 101 using one or more fasteners per mounting assembly.

The mounting assemblies 111-114 can be formed of an inorganic material, such as a metal or metal alloy. In particular instances, the mounting assemblies 111-114 may be formed of a metal alloy comprising a transition metal element such as iron. In particular instances, each of the mounting assemblies 111-114 may be formed of steel.

The abrasive article 200 can include grinding segments (including for example, enumerated grinding segments 115 and 117) that can be removably coupled to the mounting assemblies 111-114. In particular, each of the mounting assemblies 111-114 can include a plurality of grinding segments. As illustrated, the grinding segments (e.g., 115 and 117) can be circumferentially disposed around the base 101 along the outer periphery in a circular pattern. Moreover, the grinding segments 115 and 117 can be spaced apart from each other such that a gap (e.g. 116) exists between the grinding segments 115 and 117. The mounting assemblies 111-114 facilitate attachment of the grinding segments (e.g., 115 and 117) to the base 101. In particular, the mounting assemblies 111-114 facilitate removable coupling of the grinding segments (e.g., 115-117) to the base 101. The grinding segments (e.g., 115 and 117) can be removable coupled to the mounting assemblies 111-114 as described in more detail herein.

While FIG. 1B illustrates one particular orientation of the grinding segments (e.g., 115 and 117) relative to the base 101 via the mounting assemblies 111-114, it will be appreciated that the embodiments herein are not to be interpreted as so limited, and various other orientations of the grinding segments relative to the base can be used. For example, the grinding segments can extend in a direction substantially normal to the upper surface 103 of the base 101, or alternatively, the grinding segments can extend from the outer side surface 105 of the base 101. In fact, embodiments herein contemplate formation of an abrasive article, wherein the grinding segments do not have the same orientation relative to each other. For example, a first set of grinding segments can have a first orientation relative to the base, and a second set of grinding segments can have a second orientation relative to the base, and particularly, the orientation of the second set of grinding segments can be different from the orientation of the first set of grinding segments. Furthermore, it will be appreciated, that the first and second set of grinding segments may differ from each other in terms of material characteristics.

Figure 6:
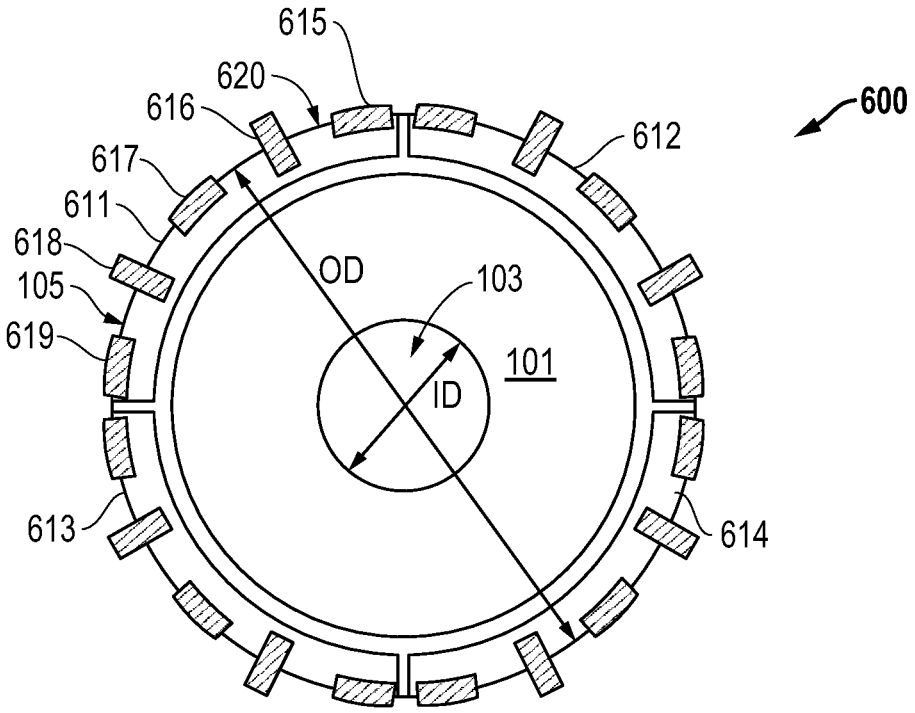
FIG. 6 includes a top view illustration of an abrasive article according to an embodiment.

Referring briefly to FIG. 6, a top view illustration of an alternative abrasive article is illustrated in accordance with an embodiment. As illustrated the abrasive article 600 is similar to the abrasive article 200 of FIG. 1B. Notably, the abrasive article 600 can include mounting assemblies 611, 612, 613, and 614 (611-614) disposed on the upper surface 103 of the base 101 and arranged circumferentially around the base 101 adjacent to and/or abutting the outer side surface 105. Each of the mounting assemblies 611-614 can be circumferentially spaced apart from each other along an outer circumference of the base 101, such that a circumferential gap may exist between each of the mounting assemblies. It will be appreciated that while the abrasive article 600 is illustrated as including four mounting assemblies 611-614 are illustrated, other embodiments, may utilize a fewer or greater number of mounting assemblies.

Moreover, the abrasive article 600 can include grinding segments that are removably coupled to the base 101. In particular, the abrasive article 600 can include two sets of grinding segments, that have a different orientation with respect to the base 101 and a different orientation between the first and second sets. For instance, the mounting assembly 611 includes grinding segments 615, 616, 617, 618, and 619 (615-619). The grinding segments 615-619 can be separated into distinct sets based on their orientation relative to the base 101 on the mounting assembly 611. For example, as illustrated, the grinding segments 615, 617 and 619 can be part of a first set having the same orientation relative to the base 101. The grinding segments 616 and 618, which may be considered part of a separate set from the grinding segments 615, 617, and 619 can be rotated relative to the base 101, such that the grinding segments 616 and 618 are orientated at a different angle relative to the base 101 than the grinding segments 615, 617, and 619. As illustrated, the grinding segments 616 and 618 of the second set can be rotated to have a perpendicular orientation relative to the grinding segments 615, 617, and 619. However, it will be appreciate that the abrasive article 600 can be formed to include more than two sets of grinding segments, wherein each of the grinding segments within a set can have a different orientation relative to the base. Moreover, while the orientation between the first and second set of grinding segments is illustrated as substantially perpendicular, other suitable angled orientation can be used.

Referring again to FIG. 1B, in accordance with an embodiment, each of the grinding segments can comprise a grinding body having abrasive grains contained within a matrix material. Notably, the grinding segments can be bonded abrasive articles wherein the abrasive grains are contained within a three-dimensional matrix of material. The abrasive grains can include an abrasive particulate material having a Mohs hardness of at least about 4, such as at least about 5, at least about 6, or even at least about 7. In particular instances, the abrasive grains can include a superabrasive material, such as diamond, cubic boron nitride, or a combination thereof. In one embodiment, the abrasive grains consist essentially of diamond.

In certain embodiments, the abrasive particles can be selected to have a particle size of not less than about 400 US mesh, such as not less than about 100 US mesh, such as between about 16 and 100 US mesh. Depending on the intended application of the abrasive article, the size of the abrasive grains can be between about 30 and 60 US mesh.

The matrix material of the grinding segments can include an inorganic material, such as a vitreous bond, metal bond, metal alloy bond, and a combination thereof. In particular instances, the matrix material may include a metal or metal alloy, and particularly, can be formed from a transition metal element or even a combination of transition metal elements.

In certain embodiments, the grinding segments can be an infiltrated bonded abrasive article such as those disclosed in U.S. patent application Ser. No. 61/087,430, filed Aug. 8, 2008, entitled "Abrasive Tools Having a Continuous Metal Phase For Bonding An Abrasive Component To a Carrier." In such instances, the grinding segments can include abrasive grains contained within a metal matrix, wherein the grinding segment further includes an interconnected network of pores, which can be filled with an infiltrant material. The metal matrix can include a metal element or metal alloy including a plurality of metal elements.

As noted above, the abrasive member can be formed such that an infiltrant is present within the interconnected network of pores within the body of the grinding segment. The infiltrant can partially fill, substantially fill, or even completely fill the volume of the pores extending through the volume of the grinding segment. In accordance with one particular design, the infiltrant can be a metal or metal alloy material.

Figure 2A:
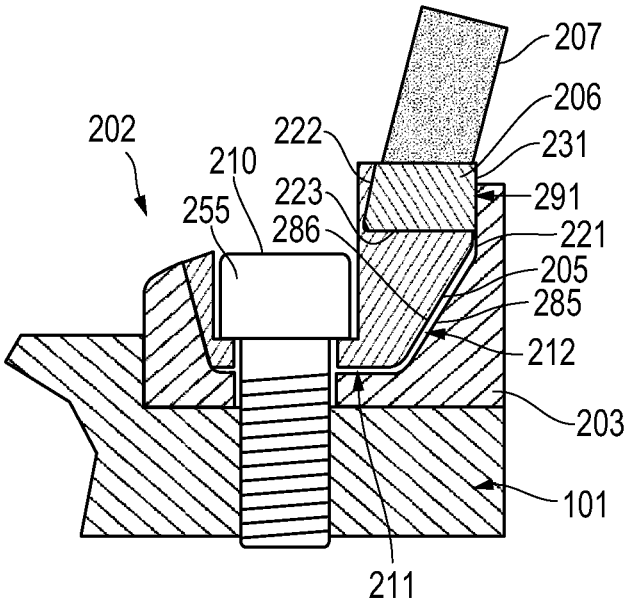
FIG. 2A includes a cross-sectional view of a portion of an abrasive article in accordance with an embodiment.

FIG. 2A includes a cross-sectional illustration of a portion of an abrasive article in accordance with an embodiment. In particular, FIG. 2A may represent a portion of an abrasive article as viewed through plane BB illustrated in FIG. 1B. FIG. 2A includes a cross-sectional illustration of the base 101, a mounting assembly 202 removably attached to the base 101, and a grinding segment 207 coupled to the mounting assembly 202. In accordance with an embodiment, the mounting 202 assembly can include multiple components. For example, the mounting assembly of FIG. 2A can include an upper mounting member 205 and a lower mounting member 203. In particular instances, the lower mounting member 203 and upper mounting member 205 can fit together in the form of a complementary engagement structure. That is, the lower mounting member 203 has surfaces which are formed to compliment surfaces of the upper mounting member 205 such that the two members 203 and 205 can fit together, and in certain instances, slideably engage each other.

Figure 2B:
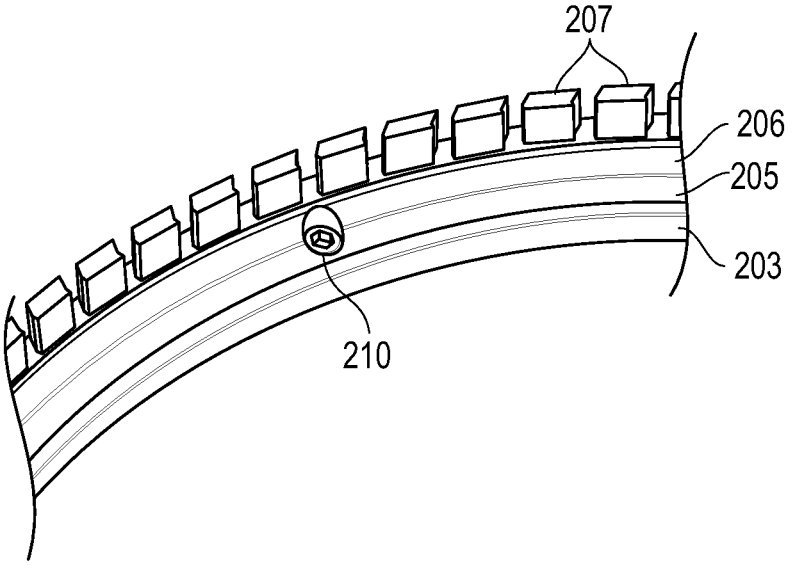
FIG. 2B includes a perspective view illustration of a portion of an abrasive article in accordance with an embodiment.
Figure 2C:
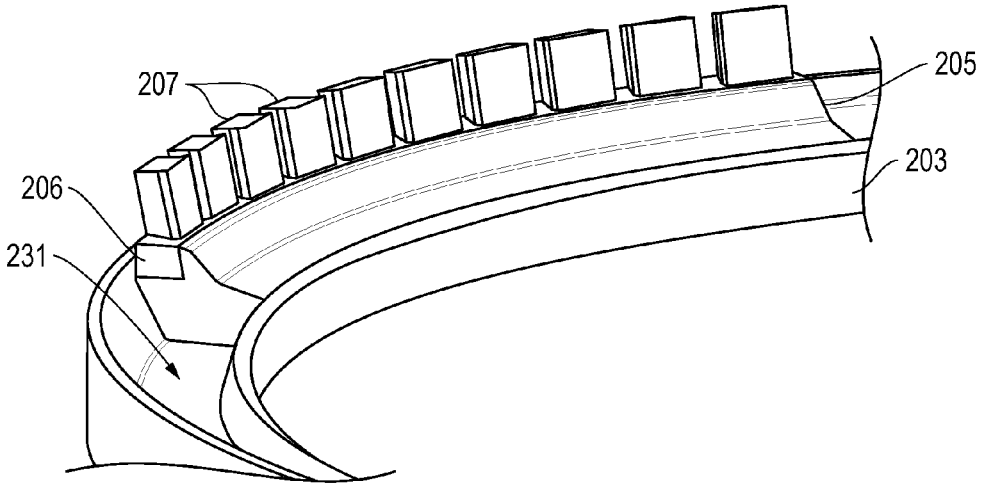
FIG. 2C includes a perspective view illustration of a portion of an abrasive article in accordance with an embodiment.

In particular instances, the lower mounting member 203 can have surfaces shaped to form a channel, as more clearly shown in the perspective view illustration of FIG. 2C. The lower mounting member 203 can have surfaces defining a channel 231 that extends through an arc of a particular circumference and has a radial width suitable for engagement of the upper mounting member 205 therein. As such, as illustrated in FIG. 2A, the lower mounting member 203 can have a generally U-shaped cross-sectional contour to form the channel 231 for engagement of the upper mounting member 205, or at least a portion of the upper mounting member 205, therein.

In particular, wherein the upper mounting member 205 is fully engaged (e.g., completely seated within the channel 231 of the lower mounting member 203 as shown in FIG. 2A) with the lower mounting member 203, a gap 211 may exist between a lower surface of the upper mounting member 205 and upper surface of the lower mounting member 203 within the channel 231. As such, the depth of the channel 231 can be greater than the height of the tapered sidewalls of the upper mounting member 205 such that when the upper mounting member 205 is engaged within the channel 231, and fully fastened via a fastener 210, to the lower mounting member 203 the gap 211 is formed. The dimensions noted in the foregoing can facilitate proper engagement of the sector 206, and therefore, the grinding segment 207, within the mounting assembly 202 as will be described in more detail herein.

Additionally, wherein the upper mounting member 205 is fully engaged with the lower mounting member 203, a gap 212 can be formed between the outer tapered surface 285 of the lower mounting member 203 and the outer tapered surface 286 of the upper mounting member 205. Like the gap 211, the gap 212 can be purposefully formed based on differences in geometry between the lower mounting member 203 and the upper mounting member 205 to facilitate exertion of a clamping force on the sector 206 to secure the grinding segment 207 to the mounting assembly 202 and the base 101. Notably, the mounting assembly 202, and particularly, the lower mounting assembly 205 can exert a radial force against the sector 206, and it may be a radially compressive force. In particular, the channel 231 of the lower mounting member 203 can be formed to have a radial width that exceeds the radial width of the upper mounting member 205, which facilitates formation of the gap 212 in the fully engaged position.

As illustrated in FIGS. 2A-2C, the upper mounting member 205 may be engaged within a channel 231 of the lower mounting member 203, and in particular, the mounting assembly 202 can be removably coupled to the base 101. In certain designs, the mounting assembly 202 can be fastened to the base 101 via an upper surface of the base 101 using fastener 210. That is, the fastener is configured to first engage the mounting assembly 202 and the upper surface 103 of the base 101 via the fastener 210. In other embodiments (see, FIGS. 4A & B) the mounting assembly is fastened to the base via a lower surface of the base 101, where the fastener is configured to initially engage a lower surface of the base 101 and thereafter engage the mounting assembly. As further illustrated, in embodiments utilizing a mounting assembly 202 fastened to the base 101 via the upper surface of the base 101, the head 255 of the fastener 210 is configured to engage portions of the mounting assembly 202 and axially spaced apart from surfaces of the base 101. As will be appreciated, a plurality of fasteners may be used to secure a single mounting assembly 202 to a portion of the base 101 such that the fasteners are circumferentially spaced apart from each other along an arc segment of the mounting assembly 202.

Referring again to FIG. 2A, as illustrated, the grinding segment 207 can be removably coupled to the mounting assembly 202. In accordance with one embodiment, the grinding segment 207 can be coupled to a sector 206, and may be fixably attached to the sector 206, which is configured to be directly coupled to the mounting assembly 202. In certain embodiments, the sector 206 can be an article facilitating joining of the grinding segment 207 to the mounting assembly 202. In certain instances, the sector 206 can be formed of a metal or metal alloy material. Notably, the sector 206 can be essentially free of abrasive grains such that it facilitates mounting of the grinding segment 207 to the mounting assembly 202.

Moreover, the grinding segment 207 may be bonded to the sector 206. Examples of suitable bonding mechanisms between the grinding segment 207 and the sector 206 can include brazing, welding, and infiltration bonding.

In accordance with one embodiment, the sector 206 can be removably coupled to the mounting assembly 202. In particular, the sector 206 can be clamped within the mounting assembly 202. More particularly, the sector 206 can be clamped within a channel of the mounting assembly 202, wherein the channel can be formed between surfaces of the upper mounting member 205 and the lower mounting member 203. That is for example, as illustrated in FIG. 2A, the surfaces 222 and 223 of the upper mounting member 205 and the surface 221 of the lower mounting member 203 may form a generally U-shaped channel as viewed in cross-section where the sector 206 can be disposed and clamped therein. That is, in certain instances the channel formed by the surfaces 221, 222, and 223, of the upper mounting member 205 and lower mounting member 203 can exert forces (e.g., radial forces) on the sector 206 when the mounting assembly 202 is fully engaged with the base 101. Notably, the surface 221 can directly contact the outer radial surface 231 of the sector 206 and exert a radial inward force 291 on the sector 206, forcing the sector 206 against the surface 222, and therein clamping and holding the sector 206 in position. The clamping arrangement facilitates positioning and holding of the sector 206 and the grinding segment 207 relative to the base 101 and mounting assembly 202, without the use of a fastener directly engaging the sector 206 or grinding segment 207. Moreover, when the sector 206 is fully engaged within the mounting assembly 202, a portion of the mounting assembly 202 can be under a compressive force. That is, the lower mounting assembly 203 can exert a compressive force (e.g., a radially compressive force) on at least a portion of the upper mounting assembly 205.

Figure 3A:
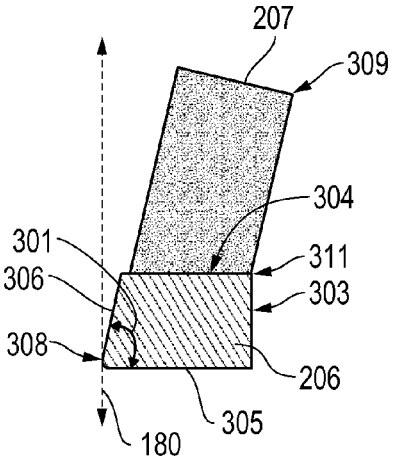
FIGS. 3A-3C includes cross-sectional illustrations grinding segments and sectors in accordance with embodiments.

Notably, the combination of the multiple components mounting assembly 202 and the shape of the sector 206 can facilitate clamping engagement of the sector 206 within the mounting assembly 202. Turning to FIG. 3A, a cross-sectional illustration of a grinding segment and sector is illustrated in accordance with one embodiment. Notably, the sector 206 is formed such that it has a generally trapezoidal cross-sectional shape. That is, it is a quadrilateral shape wherein at least two sides are parallel to each other and a pair of sides that define surfaces that are non-parallel to each other, or stated alternatively, define intersecting planes. In particular, one side can be perpendicular to one of the pair of parallel sides. The sector 206 can include an upper surface 304 and a lower surface 305 opposite the upper surface, which are substantially parallel to each other. The sector 206 can further include an outer radial surface 303 and an inner radial surface 306 opposite the outer radial surface, wherein the outer radial surface 303 and the inner radial surface 306 define substantially intersecting planes. Moreover, the outer radial surface 303 can be oriented such that it is generally perpendicular to the upper surface 304 and the lower surface 305.

Figure 3B:
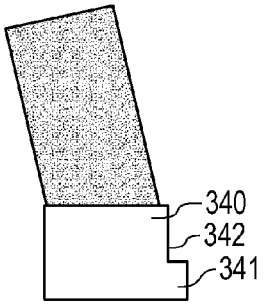

In accordance with one embodiment, the inner radial surface 306 and the lower surface 305 can form a joining angle 301 as illustrated in FIG. 3 as the measure of the angle between the surfaces 306 and 305. Such an angle results in the inner radial surface 306 being angled relative to the central axis 180. In accordance with an embodiment the joining angle 301 can be an acute angle (i.e., less than about 90°). For example, in particular instance, the joining angle 301 can have an angle of less than about 85°, and particularly within a range between about 45° and about 85°.

Moreover, in certain instances, the connection between the inner radial surface 306 and the lower surface 305 of the sector 206 may be defined by a radiused edge 308. That is the radiused edge 308 may not form a sharp corner, rather a rounded corner having a radiused surface.

Furthermore, the upper mounting member 205 can be formed such that surface 222 is angled relative to the central axis 180 at the same angle as the inner radial surface 306 of the sector 206 relative to the central axis (See, FIG. 2A). The surface 222 can be configured to directly engage and lie flush against the inner radial surface 306 of the sector 206.

As further illustrated in FIG. 3A, the grinding segment 207 may be angled relative to the central axis 180 such that it is tilted in a radially outward relative to the central axis 180. In particular, the grinding segment 207 may be angled such that an upper outer radial edge 309 is disposed at a greater radial distance from the central axis 180 than a lower outer radial edge 311 of the grinding segment 207. In short, the upper outer radial edge 309 can protrude radially beyond the lower outer radial edge 311, and more particularly, beyond the outer side surface 105 of the base 101. Such a design can facilitate engagement of the grinding segments of the abrasive article with a work surface disposed at a distance from the outer side surface 105 of the base. It will be appreciated, that while FIG. 3A illustrates one configuration of the grinding segment, the grinding segment can be oriented in various other suitable configurations, and is not limited to the illustrated embodiment.

While FIG. 3A has described a sector having a particular cross-sectional shape, it will be appreciated that other shapes can be utilized, and particularly, any range of polygonal shapes, and irregular shapes that facilitate clamping of the sector within the mounting assembly. For example, FIG. 3B includes a cross-sectional view of a sector and grinding segment in accordance with an embodiment. As illustrated, the sector 340 can be formed to have a generally L-shaped contour, which may facilitate clamping of the sector 340 within the mounting assembly as described herein. In particular, the sector 340 can have a flange 341 extending radially inward from a radial side surface 342 configured to be engaged with a portion of the upper mounting assembly 205 for clamping of the sector 340 between the upper mounting assembly 205 and the lower mounting assembly 203. It will be appreciated that the upper mounting assembly 205 may have a different contour than those illustrated here for complementary engagement of the surfaces of the flange 341.

Figure 3C:
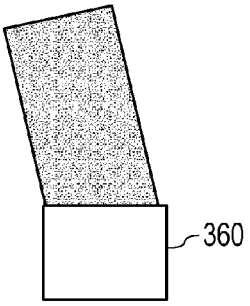

FIG. 3C includes a cross-sectional view of a sector and grinding segment in accordance with an embodiment. As illustrated, the sector 360 has a generally rectangular shape, and more particularly, a square cross-sectional shape.

Figure 4A:
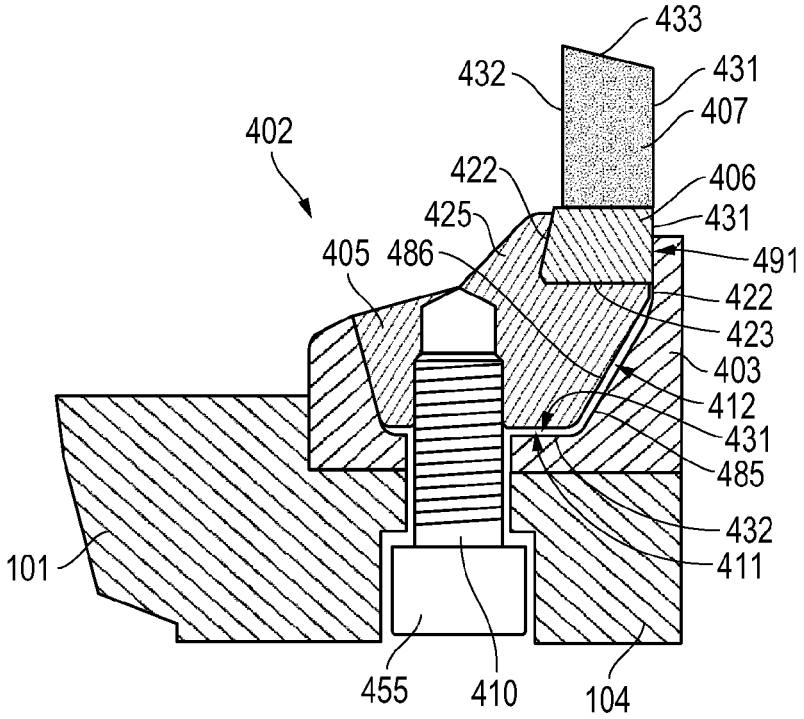
FIG. 4A includes a cross-sectional illustration of a portion of an abrasive article in accordance with an embodiment.
Figure 4B:
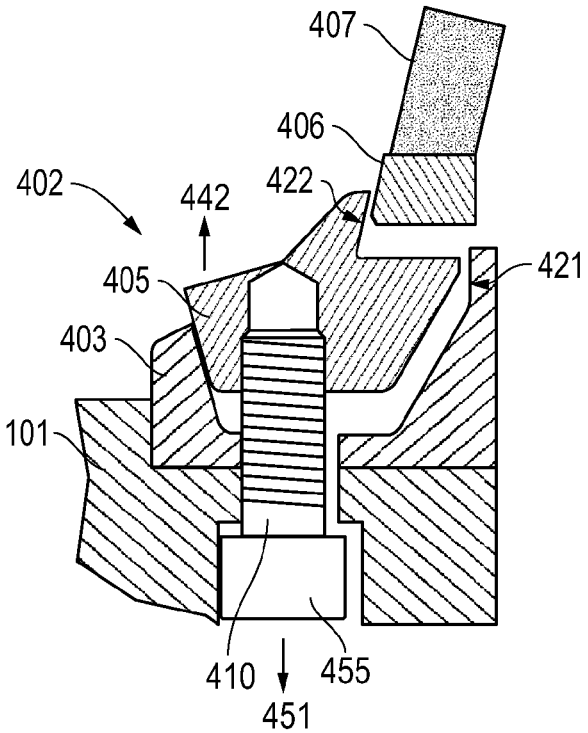
FIG. 4B includes a cross-sectional illustration of a portion of an abrasive article in accordance with an embodiment.

FIGS. 4A and 4B include cross-sectional illustrations of a portion of an abrasive article in accordance with an embodiment. For example, the illustrations of FIGS. 4A and 4B can be portions of an abrasive article as viewed through the plane AA as provided in FIG. 1B. FIG. 4A includes a cross-sectional illustration of portion of an abrasive article wherein the fastener 410 is illustrated in an engaged position within the mounting assembly. By contrast, as will be described later, FIG. 4B includes a cross-sectional illustration of an abrasive article wherein the fastener is illustrated in a disengaged position, and therein partially unseated, yet still engaged, with the mounting assembly. Movement of the fastener 410 between an engaged position and a disengaged position may only require a few rotations (e.g., not greater than 2, not greater than 3, or not greater than 4 rotations) of the fastener 410.

Referring to FIG. 4A, a mounting assembly 402 is illustrated as being coupled to the base 101 via a fastener 410. As illustrated, the mounting assembly 402 is fastened to the base 101 via the rear surface 104 of the base 101 such that the head 455 of the fastener 410 is engaged with the base 101. As further illustrated, the mounting assembly 402 can include a lower mounting member 403 and an upper mounting member 405 as described herein. The upper mounting member 405 can be coupled to the lower mounting member 403 in the same manner as described in the embodiment of FIG. 2A.

In particular, a gap 411 can be formed between a lower surface 431 of the upper mounting member 405 and an upper surface 432 of the lower mounting member 403 when the mounting assembly 402 is in an engaged position with the plate 101. In the engaged position, the fastener 410 is fully seated within the mounting assembly 402 and the head is engaged with the base 101. As illustrated, the gap 411 can extend for the full radial width of the upper surface 432 of the lower mounting member 403 (i.e., through the width of the channel formed in the lower mounting member 403). As described herein, the gap 411 may be purposely formed based on the dimensions of the lower mounting member 403 and the upper mounting member 405 to assure proper engagement of the sector and grinding segment.

Additionally, wherein the upper mounting member 405 is fully engaged with the lower mounting member 403, a gap 412 can be formed between the outer tapered surface 485 of the lower mounting member 403 and the outer tapered surface 486 of the upper mounting member 405. Like the gap 411, the gap 412 can be purposefully formed based on differences in geometry between the lower mounting member 403 and the upper mounting member 405 to facilitate exertion of the suitable forces (e.g., clamping forces) on the sector 406 to secure the grinding segment 407 to the mounting assembly 402 and the base 101.

Moreover, like the embodiment of FIG. 2A, the sector 406 can be clamped within the mounting assembly 402, and particularly between surfaces 421, 422, and 423 of the upper mounting member 405 and lower mounting member 403. In particular, the sector 406 can be clamped in a channel formed between the surfaces 422 and 423 of the upper mounting member 405 and a surface 421 of the lower mounting member 403. The upper mounting member 405 can have an arm portion 425, which may have a greater radial thickness than the arm of the upper mounting member 405 of the embodiment illustrated in FIG. 2A.

In certain instances, the channel formed by the surfaces 421, 422, and 423, of the upper mounting member 405 and lower mounting member 403 can exert forces (e.g., radial forces) on the sector 406 when the mounting assembly 402 is fully engaged with the base 101. Notably, the surface 421 can directly contact the outer radial surface 431 of the sector 406 and exert a radial inward force 491 on the sector 406, forcing the sector 406 against the surface 422, and therein, clamping and holding the sector 406 in position within the mounting assembly 402. The clamping arrangement facilitates positioning and holding of the sector 406 and the grinding segment 407 relative to the base 101, without the use of a fastener directly engaging the sector 406 or grinding segment 407.

FIG. 4A further includes a cross-sectional illustration of a grinding segment 407 having an alternative shape according to an embodiment. As illustrated, the grinding segment 407 can have a trapezoidal shape. In accordance with the illustrated embodiment, the grinding segment 407 can have a tapered upper surface 433, which is oriented at a non-perpendicular angle relative to the inner side surface 432 and outer side surface 431 of the grinding segment 407. The grinding segment 407 demonstrates that various cross-sectional geometries of grinding segments are suitable for use with the abrasive articles disclosed herein.

Turning to FIG. 4B, the fastener 410 is illustrated as being in a disengaged position, wherein it is partially unseated from the mounting assembly 402. In the disengaged position, the head portion 455 of the fastener 410 can be spaced apart from the surfaces of the base 101, as the fastener 410 is moved in the direction 451. The disengaged position can allow partial unseating of the upper mounting member 405 from the lower mounting member 403 in an axial direction 422 as shown. Notably, in the disengaged position, the fastener 410 may not necessarily be fully removed from the mounting assembly or even completely removed from the upper mounting member 405. Upon placing the fastener 410 in a disengaged position, the forces exerted by the upper mounting member 405 on the sector 406 can be reduced, or even completely removed. As such, in the disengaged position, the dimensions of the channel formed between the surfaces 421, 422, and 423 of the upper mounting member 405 and the lower mounting member 403 can be changed (i.e., reduced), such that the sector 406, and thus the grinding segment 407, can be released from the mounting assembly 402. As such, in the disengaged position, the upper mounting member 405 can be partially separated from the lower mounting member 403, thereby releasing the clamping forces of the mounting assembly 402 on the sector 406 allowing for the grinding segment 407 to be removed from the mounting assembly 402. Such a design thereby facilitates quick replacement of grinding segments and repair of the abrasive article, since none of the fasteners 410 may need to be completely removed from the mounting assembly 402 or more particularly the base 101.

More notably, in the designs of the embodiments herein, the fastener 410 configured to engage the base 101 and the mounting assembly 402 can be spaced apart from and disengaged from the grinding segment 407 and sector 406. That is, a fastener is not utilized for direct coupling between the sector 406 and the mounting assembly 402 or the sector 406 and the base 101.

Figure 5:
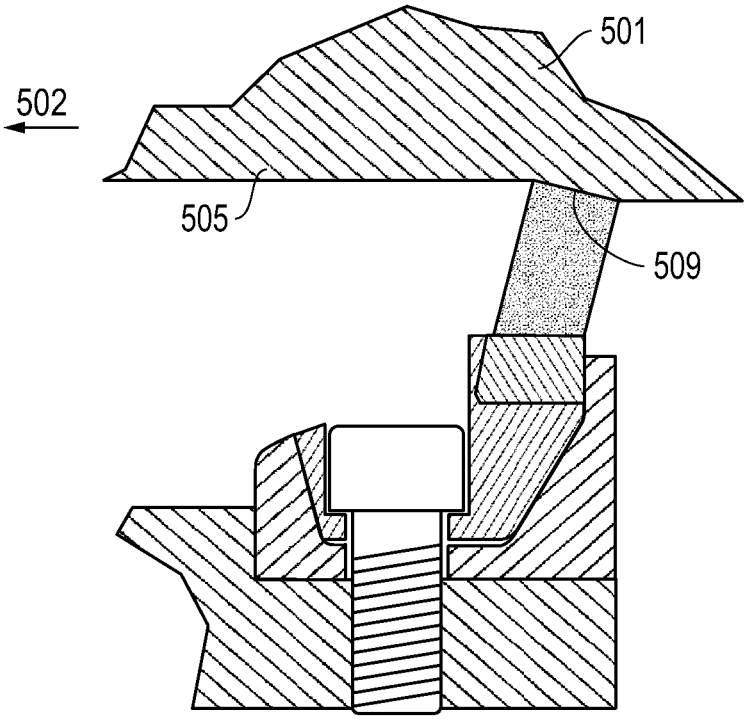
FIG. 5 includes an illustration of a grinding operation conducted by an abrasive article of the embodiments herein.

FIG. 5 illustrates a picture of the grinding operation conducted by the abrasive articles of the embodiments herein. In particular a work piece 501 can be moved (e.g., rotated and moved in an axial direction) relative to the abrasive article 500, or the abrasive article 500 can be moved relative to the work piece 501, or both the workpiece 501 and abrasive article 500 can be moved relative to each other to accomplish grinding of a surface 505 of the work piece 501. In particular instances, the work piece 501 can be moved in a direction 502 as illustrated, while the abrasive article 500 is being rotated at high speeds. The upper surface 509 of the grinding segment are positioned to make first contact with the work piece 501 and remove material from the surface 505 of the work piece 501. The work piece 501 can also be moved in other direction to accomplish grinding and finishing of the surface 505. In particular instances, the abrasive articles of the embodiments herein are particularly suited for finishing surfaces of building materials, such as stone, concrete, and brick, and more particularly, can be used to planarize faces of such building materials.

According to an embodiment, the abrasive tool includes a base, a mounting assembly, and a plurality of grinding segments. In particular, the following embodiments have set forth a particular combination of design features enabling quick repair and tool change of abrasive articles having the features of the embodiments by utilizing multi-component mounting assemblies, particular geometries of the mounting assembly components, sectors having particular features, and grinding segments having particular features. Additionally, the placement of fasteners with respect to the surfaces of the base, particularly, the use of fasteners engaging the rear surface of the base can facilitate improved lifetime of the abrasive article by limiting the effects of swarf on the openings for the fasteners. Moreover, the embodiments herein can utilize multiple grinding segments per sector, multiple sectors per mounting assembly, and multiple mounting assemblies per base, which can aid quick repair and tool change. Notably, the embodiments herein enable one to service an abrasive article with minimal effort, including shorter down time due to easier assembly construction. Additionally, in construction of such grinding rings, balancing of the ring suing the features of the embodiments herein can be conducted with greater ease given the greater versatility through use of multiple mounting assembly components on a single base.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

What is claimed is:

1. An abrasive article comprising:

a base having a central axis of rotation;

a mounting assembly coupled to the base, wherein the mounting assembly comprises an upper mounting member coupled to a separate and discrete lower mounting member, wherein the lower mounting member defines a channel that extends through an arc of a circumference around the central axis of rotation of the base; and a grinding segment coupled to a sector, wherein the sector is clamped between a surface of the upper mounting member and a surface of the lower mounting member.

2. The abrasive article of claim 1, wherein the base comprises an annular shape defining a central opening.

3. The abrasive article of claim 1, wherein the mounting assembly is coupled to the base via a fastener.

4. The abrasive article of claim 1, wherein a gap exists between the upper mounting member and the lower mounting member.

5. The abrasive article of claim 1, wherein the upper mounting member is disposed within a channel of the lower mounting member.

6. The abrasive article of claim 1, wherein the upper mounting member is under a compressive force exerted by the lower mounting member.

7. The abrasive article of claim 1, wherein a plurality of mounting assemblies is removably attached to the base.

8. The abrasive article of claim 1, wherein the base comprises an outer diameter of at least 200 mm.

9. The abrasive article of claim 8, wherein the base comprises an outer diameter of at least 500 mm.

10. The abrasive article of claim 1, wherein the sector is essentially free of abrasive grains.

11. The abrasive article of claim 1, wherein the sector comprises a metal or metal alloy.

12. The abrasive article of claim 1, wherein the mounting assembly comprises a metal or metal alloy.

13. The abrasive article of claim 1, wherein the sector comprises an inner radial surface angled relative to the central axis of rotation of the base, and wherein a first surface of the upper mounting member is configured to directly engage and lie flush against the inner radial surface of the sector.

14. The abrasive article of claim 13, wherein the inner radial surface of the sector is angled relative to the central axis of rotation of the base, and wherein the first surface of the upper mounting member is angled at the same angle as the inner radial surface of the sector.

15. The abrasive article of claim 13, wherein the inner radial surface of the sector includes a flange configured to be engaged with a portion of the upper mounting member.

16. The abrasive article of claim 15, wherein the inner radial surface of the sector has a generally L-shaped contour.

17. The abrasive article of claim 13, wherein the sector is clamped between the first surface of the upper mounting member and the first surface of the lower mounting member.

18. The abrasive article of claim 13, wherein the sector comprises an outer radial surface, and wherein a first surface of the lower mounting member is configured to directly contact and exert a radial inward force on the sector.

19. The abrasive article of claim 13, wherein the upper mounting member and the lower mounting member are configured to form a complementary engagement structure.

20. The abrasive article of claim 13, wherein the lower mounting member comprises a generally U-shaped cross-sectional contour.

* * * * *